US007416144B2

(12) United States Patent
Kammerer et al.

(10) Patent No.: US 7,416,144 B2
(45) Date of Patent: Aug. 26, 2008

(54) EXCHANGEABLE BEATER

(75) Inventors: Karl Kammerer, Fluorn-Winzeln (DE); Willi Schillinger, Baiersbronn (DE)

(73) Assignee: BETEK-Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 11/367,040

(22) Filed: Mar. 2, 2006

(65) Prior Publication Data

US 2006/0226270 A1 Oct. 12, 2006

(30) Foreign Application Priority Data

Mar. 2, 2005 (DE) ..... 10 2005 009 461

(51) Int. Cl.
*B02C 13/28* (2006.01)

(52) U.S. Cl. ..... 241/197; 241/294; 241/300

(58) Field of Classification Search ..... 241/194, 241/197, 294, 300, 189.1
See application file for complete search history.

(56) References Cited

U.S. PATENT DOCUMENTS 6,419,173 B2 * 7/2002 Balvanz et al. ..... 241/291
6,435,434 B1 * 8/2002 Monyak ..... 241/197

FOREIGN PATENT DOCUMENTS

DE 93 05 835.7 7/1993
DE 102 23 887 A1 12/2003

* cited by examiner

*Primary Examiner*—Mark Rosenbaum
(74) *Attorney, Agent, or Firm*—Pauley Petersen & Erickson

(57) ABSTRACT

A percussion tool for comminuting materials, in particular wood waste materials, having a beater head and a shank, wherein a cutting insert with an upper cutting edge extending transversely with respect to the cutting direction is fastened on the beater head. If the cutting insert has at least one first cutting element and at least one second cutting element, and if a free space in the shape of the upper cutting edge is arranged on the beater head in the cutting direction behind the cutting insert, then the cutting elements are thus supported over a greatest possible surface and are connected with the beater head. It is thus possible to transfer greater forces into the beater head without it being broken off.

19 Claims, 2 Drawing Sheets

EXCHANGEABLE BEATER

BACKGROUND OF THE INVENTION

1. Field of the Invention

This invention relates to a percussion tool for comminuting materials, in particular wood waste materials, having a beater head and a shank, wherein a cutting insert with an upper cutting edge extending transversely with respect to the cutting direction is fastened on the beater head.

2. Discussion of Related Art

The shanks of exchangeable beaters for the comminution of wood or wood waste can be inserted into a receiver of a holder and fastened on the holder. The holder is pivotably seated on a rotatory body. The rotatory body is installed in a reception housing, in which the material to be comminuted is also stored.

With the rotary body turning, the percussion tools beat and divide the material to be comminuted. As fine of a defibration as possible is advantageous, because it accelerates subsequent composting. When encountering hard objects, such as stones, in the cut material to be comminuted, the holder can pivot out and yield in order to avoid impermissibly large stresses. However, damage of the cutting insert can occur because of the large stresses. A known cutting insert is divided into cutting elements or individual teeth, so that the loss of a single cutting element does not result in the loss of the entire tool.

A percussion tool is taught by German Patent Reference DE 102 23 887 A1. A cutting head is described therein, which has a main cutting element supported by a base element. For improving the cutting output, the cutting head has at least one additional cutting element extending transversely with respect to the cutting direction on both sides of the main cutting element. The embodiment described in this publication provides that the lateral cutting elements are placed at a spatial distance from the main cutting element.

One disadvantage of this arrangement is that in connection with the tool insert for comminuting green material, erosions can occur on the cutting head in the area of the holder of the hard alloy cutting elements. Erosion can also damage the front facing the material to be communicated in a disadvantageous manner during extended operations. Therefore the known cutting body is customarily used for splitting aged wood.

A cutting body with an extended service life is described in German Patent Reference G 93 05 835.7. In this case, the cutting body is substantially embodied as a cast part with a cutting edge extending parallel with respect to the circumferential axis, wherein the cutting edge has several side-by-side arranged element sectors made of a hard alloy as wear elements.

It is thus disadvantageous if the cutting elements, on their sides facing away from the material to be cut, are partially not supported by the cutting head and are thus prone to break, as well as to become separated.

SUMMARY OF THE INVENTION

It is one object of this invention to provide a percussion tool of the type mentioned above but which has an increased service life with respect to erosion, as well as with respect to the separation of cutting elements.

The object of this invention is accomplished with a cutting insert that has at least one first and at least one second cutting element, and a free space in the shape of the upper cutting edge is arranged on the beater head in the cutting direction behind the cutting insert. Thus the cutting elements are supported over as large as possible a surface and are connected with the beater head. With this arrangement they can transfer larger forces to the beater head without being broken off.

If, in the area between the cutting insert and the shank facing the material to be cut, the beater head has one or several impact plates, the particularly stressed front area is protected against erosion, to a larger extent.

In a preferred embodiment, the impact plates made of a hard alloy directly adjoin the side of the cutting elements facing away from the cutting edge. Thus the tool can still be used when a single cutting element is broken off, without becoming damaged in the short run. This reduces re-tooling times and increases the length of time the device can be used.

If the upper cutting edge is put together from element sectors with a cross section in the form of a segment of a circle, tips are formed on the cutting edge, which permit a good defibration of the cut material, but at the same time are mechanically sturdy because of the obtuse angle.

In one embodiment, the malleability of the beater head is improved if the free space behind the cutting inserts has an arcuate contour, and the upper cutting edge is formed by the arcuate cutting edge sectors of the individual cutting elements, wherein each cutting element is shaped in the form of an arc of a circle.

If the free space adjoining the cutting edge is of segments of a cross section in the form of a segment of a circle, and if the profiling of the cutting edge makes a transition into the free space over a matched rear flank face of the cutting insert, the malleability of the beater head can be improved. The penetration resistance into the material to be cut which is to be comminuted is reduced by the transition without joints, because of which less force is required and the effectiveness of the machine is improved. Also, at the same time the cutting insert can be fastened on the largest possible surface, by which the danger of individual cutting elements breaking out is reduced.

In one embodiment with improved defibration, a steep front and rear flank face is embodied on the cutting insert in front of and behind the upper cutting edge, viewed in the working direction.

If a roof-shaped profiled element with a front vertical cutting edge and front inclined cutting edges is formed on the cutting elements on the side facing the beater below the upper cutting edge, an increased number of cutting edges become active, which can defibrate the material to be cut to a greater degree and speed up rotting.

In one embodiment with increased service life of the percussion tool, an uneven number of cutting elements is provided, and the center cutting element is wider in comparison to the other cutting elements, because it is subjected to the highest mechanical stress during operation.

If the front inclined cutting edges of the center cutting element do not meet the front inclined cutting edges of the cutting elements arranged next to it, additional cutting tips are created, which improve defibration and the draw-in of the material to be cut.

BRIEF DESCRIPTION OF THE DRAWINGS

This invention is explained in greater detail in view of an exemplary embodiment represented in the drawings, wherein.

DESCRIPTION OF PREFERRED EMBODIMENTS

Figure 1:
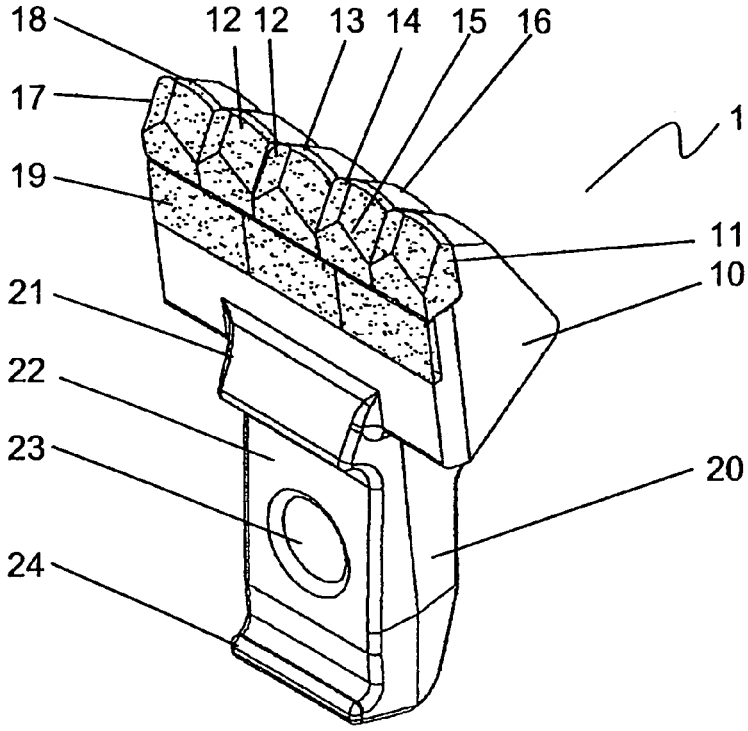
FIG. 1 shows a percussion tool in a perspective plan view, from a side facing the material to be cut.

A percussion tool 1 with a shank 20 and a beater head 10 connected therewith is shown in FIG. 1. The percussion tool 1 is fastened by a bolt, not represented here, which is passed through a fastening bore 23, on a rotating beater, also not represented, which in turn is moved by a rotatory body.

Besides the bolt, protrusions 24, 25 are used for the releasable fastening of the percussion tool 1 on the beater and for the transfer of forces occurring during the operation. The beater head 10, which is connected with the shank 20, supports a cutting insert 11 which is constructed of cutting elements 12 located side-by-side. The cutting elements 12 are connected at their back and at their underside with the beater head 10 and are generally made of a hard alloy. Customarily the connection is provided by welding or hard soldering. The cutting elements 12 have an upper cutting edge 13 and make a transition at the side facing away from the material to be cut via a rear flank face 18 into a free space 16. On the side facing the material to be cut, the cutting edge 13 makes a transition via a front flank face 17 to the flat front face of the beater face 10. Particularly aggressive cutting behavior is obtained if the front flank face 17 and the rear flank face 18 form an acute angle. A particularly great comminution effect is thus achieved. A further improvement of the defibration is achieved by the division of the front flank face 17 by a vertically angled cutting edge 14 and two inclined cutting edges 15 per cutting element 12.

The flat front side of the beater head is protected from erosion by an impact plate 19. If the impact plate 19 is divided into several individual plates, as in the embodiment shown, and if it directly adjoins the cutting insert 11, the protection effect is particularly marked, and the loss of a single plate only leads to a certain limitation of the protection effect, but not to its loss entirely. An outwardly inclined deflector 21 underneath the impact plate 19 guides material to be cut toward the outside and away from the rotating shaft of the rotatory body and thus protects the beater. The contact face 22 is used for transferring the forces occurring during operation to the rotating beater, not represented here.

Figure 2:
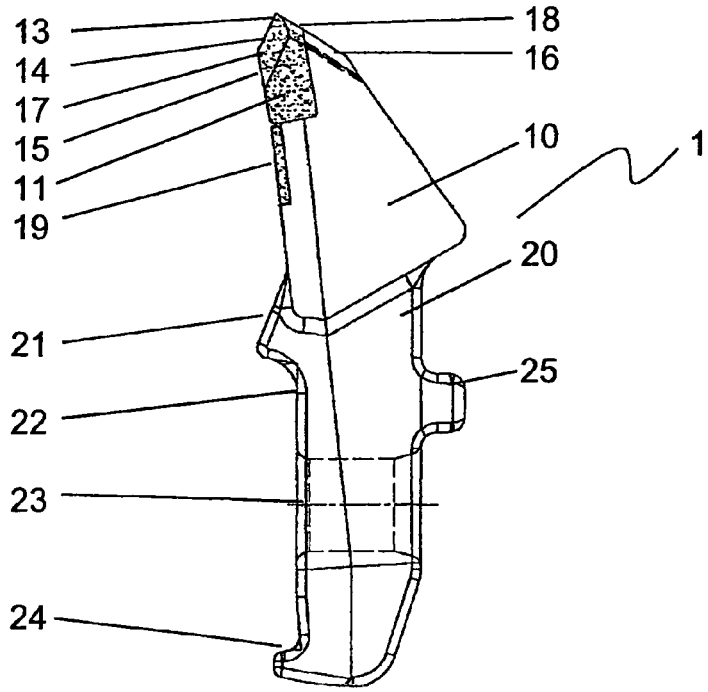
FIG. 2 shows the percussion tool in a lateral view.

FIG. 2 shows the percussion tool 1 with the beater head 10, which is widened in regard to the shank 20, in a lateral view. The fastening bore 23 is provided in the shank 20. The contact face 22 and the protrusions 24, 25 are used for transferring forces to the rotating beater. The beater head 10 supports the cutting insert 11, wherein the front working face 14 and the inclined, in the front view, cutting edges 15 have additional defibration output. The front of the cutting insert 11 makes a transition via the front flank face 17 into the upper cutting edge 13 which, in turn, makes a transition into the free space 16 via the rear flank face 18. Underneath the cutting insert 11, the impact plate 19 made of a hard alloy protects the front of the beater head against erosion.

Figure 3:
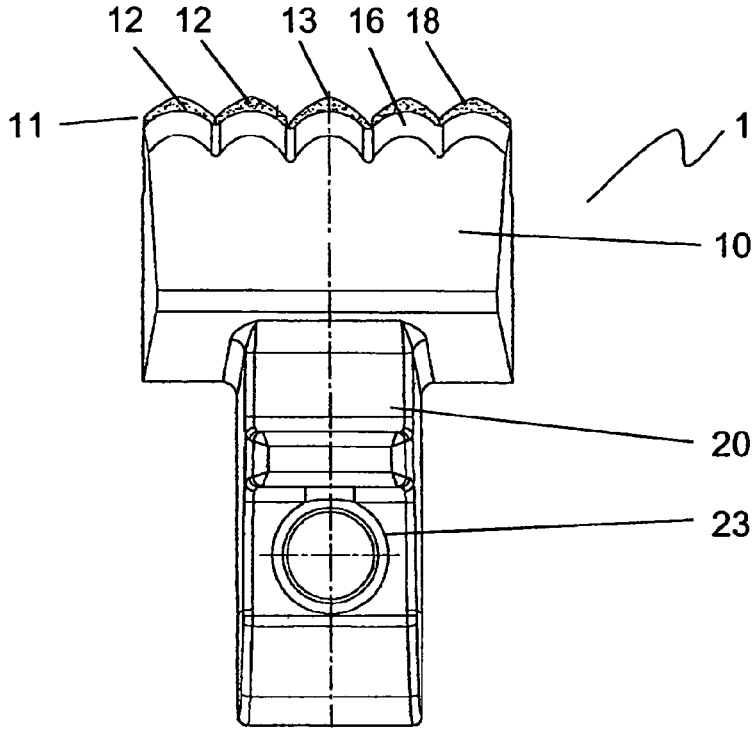
FIG. 3 shows the percussion tool from the side facing away from the material to be cut.

FIG. 3 shows the percussion tool 10 from the rear, which faces away from the material to be cut. The free surface 16 of the beater head 10 is profiled in accordance with the shape of the upper cutting edge 13 and the face of the cutting element 12 facing the beater head 10. The cutting elements 12 are thus effectively supported. This profiling offers a low penetration resistance to the material to be cut. Also, an improved chip outflow is thus achieved. In this way, the profiling makes possible an improvement of the efficiency of the machine. Furthermore, the curved shape of the free space 16 improves the malleability of the beater head 10.

Figure 4:
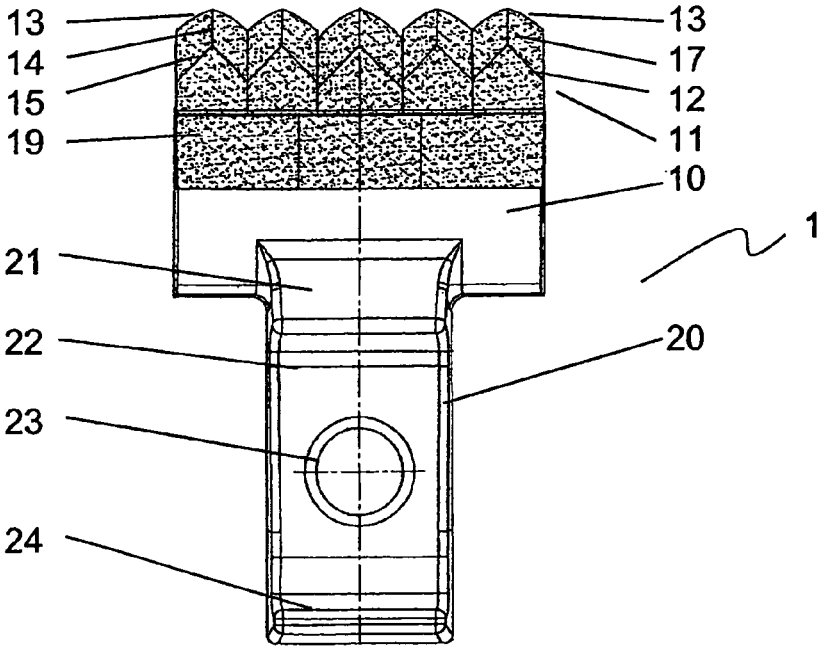
FIG. 4 shows the percussion tool from the side facing the material to be cut.

The side of the percussion tool 1 facing the material to be cut during the operation is shown in FIG. 4. The shank 20 makes a transition into the beater head 10 supporting the cutting insert 11, which is of several cutting elements 12 located side-by-side, so that the loss of one cutting element 12 does not result in the total failure of the percussion tool 1. The front flank face 17 provides the transition of the front face of the cutting insert 11 into the upper cutting edge 13. The vertically angled cutting edge 14 and the inclined cutting edges 15 divide the front flank face 11 and make possible an additional defibration output.

In the represented embodiment, the center cutting element 12 of the cutting insert 11 is designed wider than the lateral cutting elements 12, because it must absorb the greatest mechanical forces. The length of the vertically angled cutting edge 14 of this cutting element 12 is identical to that of the other cutting elements 12. The angle of inclination of the inclined cutting edges 15 is also selected to be identical in all cutting elements 12. Thus, the inclined cutting edges 15 of the center cutting element 12 do not meet the inclined cutting edges 15 of the laterally seated cutting elements 12, further cutting tips are created and it is possible to achieve an additional defibration effect. The impact plate 19 is divided into several parts, so that its protective effect in case of the loss of one part is not completely lost.

German Patent Reference 10 2005 009 461.9-23, the priority document corresponding to this invention, and its teachings are incorporated, by reference, into this specification.

What is claimed is:

1. A percussion tool (1) for comminuting materials, including wood waste materials, the percussion tool (1) comprising:

a beater head (10) connected at an end of a shank (20);

a cutting insert (11) with an upper cutting edge (13) extending transversely with respect to the cutting direction fastened on the beater head (10);

the cutting insert (11) having a first cutting element (12) and a second cutting element (12), and a free space (16) corresponding to a shape of the upper cutting edge (13) arranged on the beater head (10) in a cutting direction behind the cutting insert (11); and an impact plate (19) on the beater head (10) in an area between the cutting insert (11) and the shank (20) on a side facing a material to be cut, wherein the impact plate (19) is made of a hard alloy and directly adjoins a side of at least one of the first and second cutting elements that faces away from the cutting edge (13).

2. The percussion tool in accordance with claim 1, wherein the upper cutting edge (13) is put together from element sectors each with a cross section in a form of a segment of a circle.

3. The percussion tool in accordance with claim 2, wherein the upper cutting edge (13) is formed by the arcuate cutting edge sectors of the individual cutting elements (12), wherein each of the cutting elements (12) is shaped as an arc of a circle.

4. The percussion tool in accordance with claim 3, wherein the free space (16) adjoining the cutting edge (13) has segments each of a cross section in a form of a segment of a circle, and a profiling of the cutting edge (13) transitions over a matched rear flank face (18) of the cutting insert (11) into the free space (16).

5. The percussion tool in accordance with claim 4, wherein a steep front and a rear flank face (17, 18) is embodied on a cutting insert (11) in front of and behind the upper cutting edge (13) when viewed in a working direction.

6. The percussion tool in accordance with claim 4, wherein a roof-shaped profiled element with a front vertically angled cutting edge (14) and front inclined cutting edges (15) is formed on the cutting elements (12) on the side facing the beater head below the upper cutting edge (13).

7. The percussion tool in accordance with claim 6, wherein there is an uneven number of the cutting elements (12) and a center cutting element (12) is wider when compared to the other cutting elements (12).

8. The percussion tool in accordance with claim 7, wherein front inclined cutting edges (15) of the center cutting element (12) miss the front inclined cutting edges (15) of the cutting elements (12).

9. The percussion tool in accordance with claim 1, wherein the upper cutting edge (13) is put together from element sectors each with a cross section in a form of a segment of a circle.

10. The percussion tool in accordance with claim 9, wherein the upper cutting edge (13) is formed by the arcuate cutting edge sectors of the individual cutting elements (12), wherein each of the cutting elements (12) is shaped as an arc of a circle.

11. The percussion tool in accordance with claim 1, wherein the free space (16) adjoining the cutting edge (13) has segments each of a cross section in a form of a segment of a circle, and a profiling of the cutting edge (13) transitions over a matched rear flank face (18) of the cutting insert (11) into the free space (16).

12. The percussion tool in accordance with claim 1, wherein a steep front and a rear flank face (17, 18) is embodied on a cutting insert (11) in front of and behind the upper cutting edge (13) when viewed in a working direction.

13. The percussion tool in accordance with claim 1, wherein a roof-shaped profiled element with a front vertically angled cutting edge (14) and front inclined cutting edges (15) is formed on the cutting elements (12) on the side facing the beater head below the upper cutting edge (13).

14. The percussion tool in accordance with claim 1, further comprising a third cutting element (12) wherein the third cutting element (12) is a center cutting element (12) that is between the first and second cutting elements (12) and is wider when compared to the first and second cutting elements (12).

15. The percussion tool in accordance with claim 1, wherein front inclined cutting edges (15) of the center cutting element (12) miss the front inclined cutting edges (15) of the cutting elements (12).

16. A percussion tool (1) for comminuting materials, including wood waste materials, the percussion tool (1) comprising:

a beater head (10) connected at an end of a shank (20);

a cutting insert (11) with an upper cutting edge (13) extending transversely with respect to the cutting direction fastened on the beater head (10);

the cutting insert (11) having a first cutting element (12) and a second cutting element (12), wherein the upper cutting edge (13) is formed by cutting edge sectors of the individual cutting elements (12);

a free space (16) corresponding to a shape of the upper cutting edge (13) arranged on the beater head (10) in a cutting direction behind the cutting insert (11);

each of the first cutting element and the second cutting element including a rear flank face (18) extending between the upper cutting edge (13) and the free space (16) and a front flank face (17) extending from the upper cutting edge (13) opposite the rear flank face (18), the front flank face (17) divided by a vertically angled cutting edge (14) extending from the upper cutting edge (13).

17. The percussion tool in accordance with claim 16, wherein the free space (16) has segments each of a cross section in a form of a segment of a circle.

18. The percussion tool in accordance with claim 16, wherein in an area between the cutting insert (11) and the shank (20) on a side facing a material to be cut, the beater head (10) has at least one impact plate (19).

19. The percussion tool in accordance with claim 18, wherein the impact plate (19) is made of a hard alloy and directly adjoins the side of the cutting elements facing away from the cutting edge (13).

* * * * *